United States Patent [19]

Jahn

[11] 4,034,977

[45] July 12, 1977

[54] DETACHING DEVICE FOR A SHEET-SHAPED COPY SUPPORT

[75] Inventor: Helmut Jahn, Kelkheim, Germany

[73] Assignee: Hoechst Aktiengesellschaft, Frankfurt, Germany

[21] Appl. No.: 642,145

[22] Filed: Dec. 18, 1975

[30] Foreign Application Priority Data

Jan. 16, 1975 Germany ..... 2501487

[51] Int. Cl.[2] ..... B65H 29/56

[52] U.S. Cl. ..... 271/174; 271/DIG. 2

[58] Field of Search ..... 271/DIG. 2, 80, 97, 271/174, 195

[56] References Cited

U.S. PATENT DOCUMENTS

| | | | |
|---|---|---|---|
| 3,158,367 | 11/1964 | Tarbuck | 271/97 |
| 3,438,668 | 4/1969 | Olsson et al. | 271/97 X |
| 3,784,190 | 1/1974 | Crawford | 271/174 X |

OTHER PUBLICATIONS

Hamilton; "Paper Detach Device;" IBM Technical Disclosure Bulletin; vol. 15, No. 12; pp. 3651, May 1973.

*Primary Examiner*—Robert W. Saifer
*Attorney, Agent, or Firm*—Richard L. Schwaab

[57] ABSTRACT

A device for detaching a sheet-shaped copy support from a moving photoconductive layer by fluid pressure. The device includes a nozzle arrangement which directs pressurized fluid, such as compressed air, toward a sheet of copy paper or other copy support. The action of the fluid on the copy support creates a suction pressure which draws the copy support toward the nozzle arrangement to detach the copy support from the photoconductive layer. When the copy support has moved into close proximity and generally overlying relationship with respect to the nozzle arrangement, the fluid is passed off generally tangentially with respect to the copy support to maintain a constant suction and to avoid undesirable oscillations of the copy support. This, in turn, eliminates the undesirable noise associated with such oscillations.

4 Claims, 7 Drawing Figures

DETACHING DEVICE FOR A SHEET-SHAPED COPY SUPPORT

BACKGROUND OF THE INVENTION

1. Field of the Invention

The present invention relates to a device for detaching a sheet-shaped copy support from a moving photoconductive layer by use of a pressure medium. In the environment of the invention, a nozzle arrangement is positioned ahead of an image transfer station and near the photoconductive layer. The nozzle arrangement consists of several individual nozzles. Upon the nozzle arrangement, a first pressure can act exclusively or initially for a certain period of time followed subsequently by a second lower pressure of the medium.

2. Description of the Prior Art

A device of this kind is known from German Offenlegungsschrift No. 2,262,693 which discloses a detaching device with which, without the use of a neutralizing corona discharge device, the leading edge of a copy support can be separated by compressed air from the moving photoconductive layer, and in which detaching and feeding of the copy sheet to a transport device are achieved by means of compressed air alone. In this detaching device, a high pressure initially acts upon the nozzle arrangement for a certain period of time to produce a high flow rate, and this is followed by a lower pressure for producing a decreased flow rate. The high pressure is switched on when the leading edge of the sheet approaches the nozzle arrangement for detaching the sheet, and this high pressure is then switched off again when the nozzle arrangement is partially covered by the sheet. Subsequently, the lower pressure is switched on or maintained for guiding the sheet along the desired path very closely past the nozzle arrangement.

In addition to the foregoing type of detaching device operation with compressed air, a device is known for detaching the copy sheet wherein the leading edge of the sheet is so irradiated by means of a neutralizing corona discharge device that it is no longer electrostatically retained on the photoconductor. To detach the copy sheet, air is blown between the photoconductive layer and copy sheet, and the copy sheet is conveyed on this air cushion to another transport device. Because of the high velocity of this air, detaching of the copy sheet and of the photoconductive layer is generally not possible without the unfixed toner image on the copy sheet being destroyed.

With the initially described detaching device, the copy sheet is blown only from the back so that a suction pressure, i.e., a pressure below atmospheric, is obtained due to the Bernoulli principle. The copy sheet is moved by this partial vacuum until it is very close to the nozzles but without closing them.

There is a clearly defined distance between the nozzle outlets and the copy support or copy sheet at which maximum suction is exerted upon the copy support. When the copy support is further moved in the direction of the nozzles, that is, when the distance between the copy support and the nozzle outlets is steadily decreased, the suction effect steadily decreases, becomes zero, and finally changes into a positive pressure exerted upon the copy support, such positive pressure being greater the more the nozzle is covered by the copy support. In practice, this leads to the fact that the copy support undergoes periodic oscillations due to its mass and due to the above- described suction pressure behavior.

A possible explanation therefor may be found in that, when the copy support more closely approaches the nozzle outlets, the exhausting air no longer passes tangentially along the back of the copy support to form a partial vacuum but impinges upon the back of the copy support at a certain acute angle with respect to its surface. Thus, a change of the initial suction pressure to a positive or superatmospheric pressure occurs. The copy support is thereby blown away from the nozzle outlet until its distance therefrom is so great that a partial vacuum according to the Bernoulli principle again developes, and the suction procedure begins again. By this periodic oscillation procedure, an extremely intensive whistling tone of a frequency of about 7,000 to 9,000 cycles per second is produced. Despite optimization of all parameters of the nozzle arrangement, this undersired sound cannot be suppressed. Rather, it is of such an intensity that it hardly can be damped to a normal sound volume, even with the use of extensive sound damping measures.

SUMMARY OF THE INVENTION

It is a principal object of the invention to improve a detaching device of the initially described type in such a manner that the occurrence of a periodic oscillation and of the intensive whistling associated therewith is prevented without thereby impairing the detaching effect of the device.

Applicant's solution to this problem is characterized in that the nozzle arrangement has means which are so arranged in the vicinity of the annular nozzle outlets or in connection with the nozzle outlets that (1) sufficient flowing off of the supplied pressure medium is ensured, even when the nozzle outlets are covered by the copy support and that (2) the copy support to be detached is always exposed on its back to a pressure below the atmospheric.

The present invention achieves the advantage that, when the copy support approaches the nozzle arrangement, the copy support to be detached is prevented from moving into the zone of the pressure action of the nozzle arrangement and, due to the specific flow conditions, flowing off of the pressure medium supplied through the nozzle arrangement in a tangential direction with respect to the back of the copy support is always ensured. Thus, a partial vacuum is maintained at all times between the nozzle arrangement and copy support. This steady partial vacuum ensures that no oscillations can occur, which, in turn, effects the further advantage that expensive measures for damping the whistling are not necessary.

The device for achieving these results includes a body having at least one side, such as a downwardly facing side, for co-operation with a copy support. A nozzle or preferably a plurality of nozzles are disposed in the body, each nozzle having an outlet at the above-mentioned one side of the body. A first means, such as an outwardly flared diffuser insert, is operatively coupled with each nozzle for directing flow of fluid from the nozzle so as to draw a copy support, such as a sheet of paper, toward the first side of the body. A second means, which in one embodiment may include spacers formed of wire, is also operatively coupled with each nozzle for directing flow of fluid from the region of the nozzle outlets to discharge the fluid when a copy support is in close and/or generally overlying relationship with respect to the nozzle outlet, whereby the side of the copy support cooperating with the nozzle outlet is constantly subjected to a pressure below atmospheric and oscillations of the copy support are prevented.

That is, each nozzle is coupled with a source of fluid pressure, the nozzle being so arranged as to direct a stream of pressurized fluid generally toward a copy support to produce a suction pressure on the copy support when the copy support is disposed remotely from the nozzle. Included is means, operatively coupled with the nozzle, to prevent the action of positive pressure and to maintain suction pressure on the copy support when the copy support moves into more closely spaced relationship with respect to said nozzle outlet.

The structure and action of the invention will be further illustrated in the following by way of the exemplary embodiments shown in the drawings and described below.

BRIEF DESCRIPTION OF THE DRAWING

Referring to the drawings.

DETAILED DESCRIPTION OF THE PREFERRED EMBODIMENTS

Figure 1:
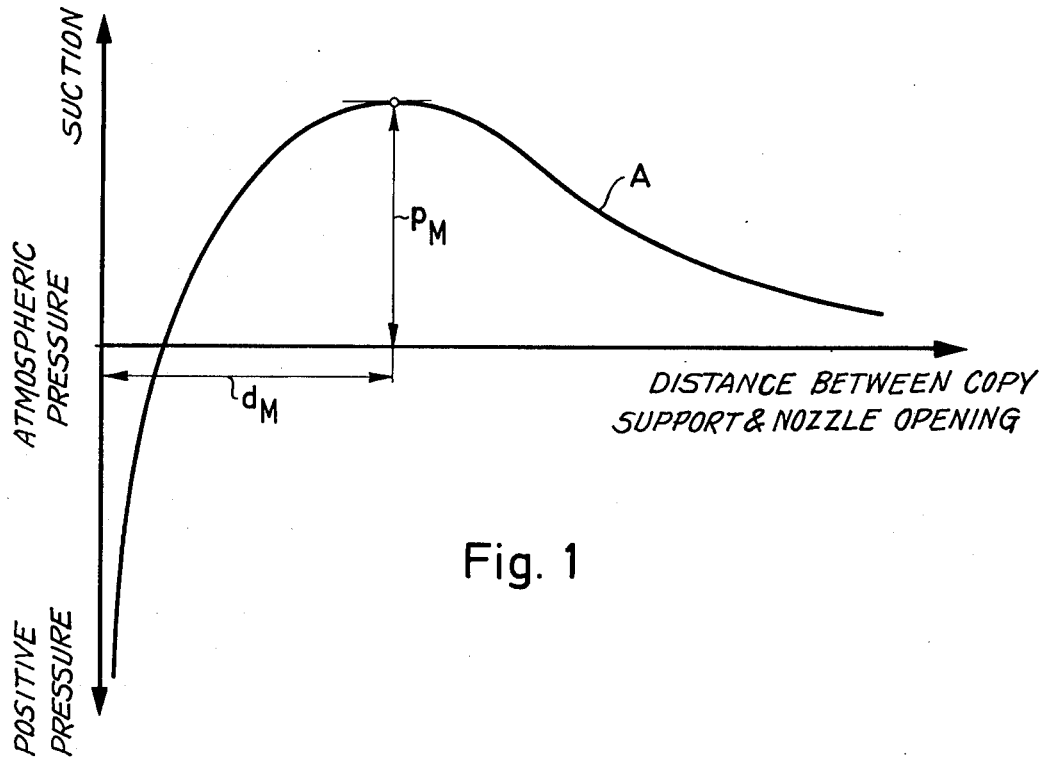
FIG. 1 is a diagrammatic view showing the curve of superatmospheric pressure and pressure below atmospheric as a function of the distance of the copy support from the outlet of a known nozzle arrangement.

Curve A in FIG. 1 shows the functional relationship between, on the one hand, the distance of a copy support from a nozzle outlet and, on the other hand, either the pressure below atmospheric, i.e., the suction pressure, or the superatmospheric pressure exerted on a copy support by a nozzle of a known detaching device. As can be seen from the curve there is a distance $d_M$ at which negative pressure, at the farthest point $p_M$ below atmospheric, is exerted on the back of the copy support which is conveyed past the nozzle outlet and, of course, maximum suction is achieved at this negative pressure value. When the copy support, e.g., a sheet, is moved towards the nozzle outlet, i.e., when the distance of the sheet from the nozzle outlet is decreased, the suction steadily decreases, becomes zero, and finally changes into a positive pressure which increases as the sheet approaches the nozzle outlet and covers it.

As a practical matter, the sheet, due to its mass and due to the change from negative to positive pressure, undergoes periodic oscillations in the transition zone. An extremely intensive whistling tone of a frequency of about 7,000 to 9,000 cycles per second is produced thereby, which, despite optimization of all parameters, cannot be suppressed.

Figure 2:
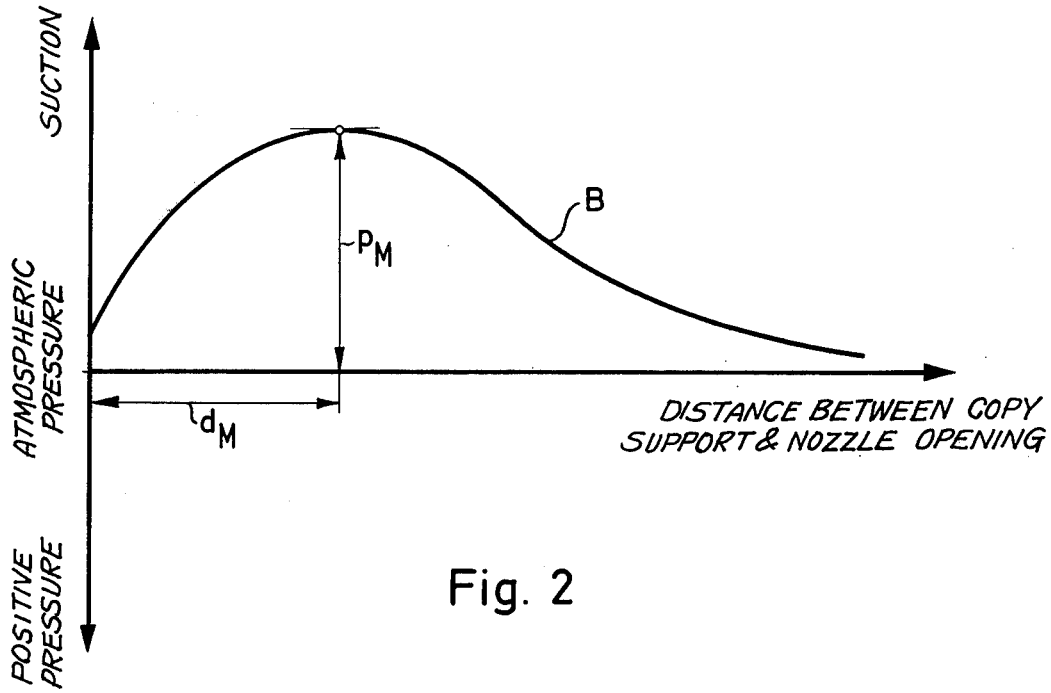
FIG. 2 is a diagrammatic view showing the relationship between pressure below atmospheric and the distance of the copy support from a nozzle outlet in accordance with the invention.

FIG. 2 shows curve B which shows the relationship between pressure below atmospheric exerted on the back of the copy support and the distance of the copy support from the nozzle outlet in accordance with the invention. The figure shows that a partial vacuum is steadily exerted on the copy support, even when the copy support is at a distance of almost zero from the nozzle outlet. Curve B is obtained, as described below, by avoiding transfer of the copy support to be detached to a zone of superatmospheric pressure as the copy support approaches the nozzle outlet.

Figure 3:
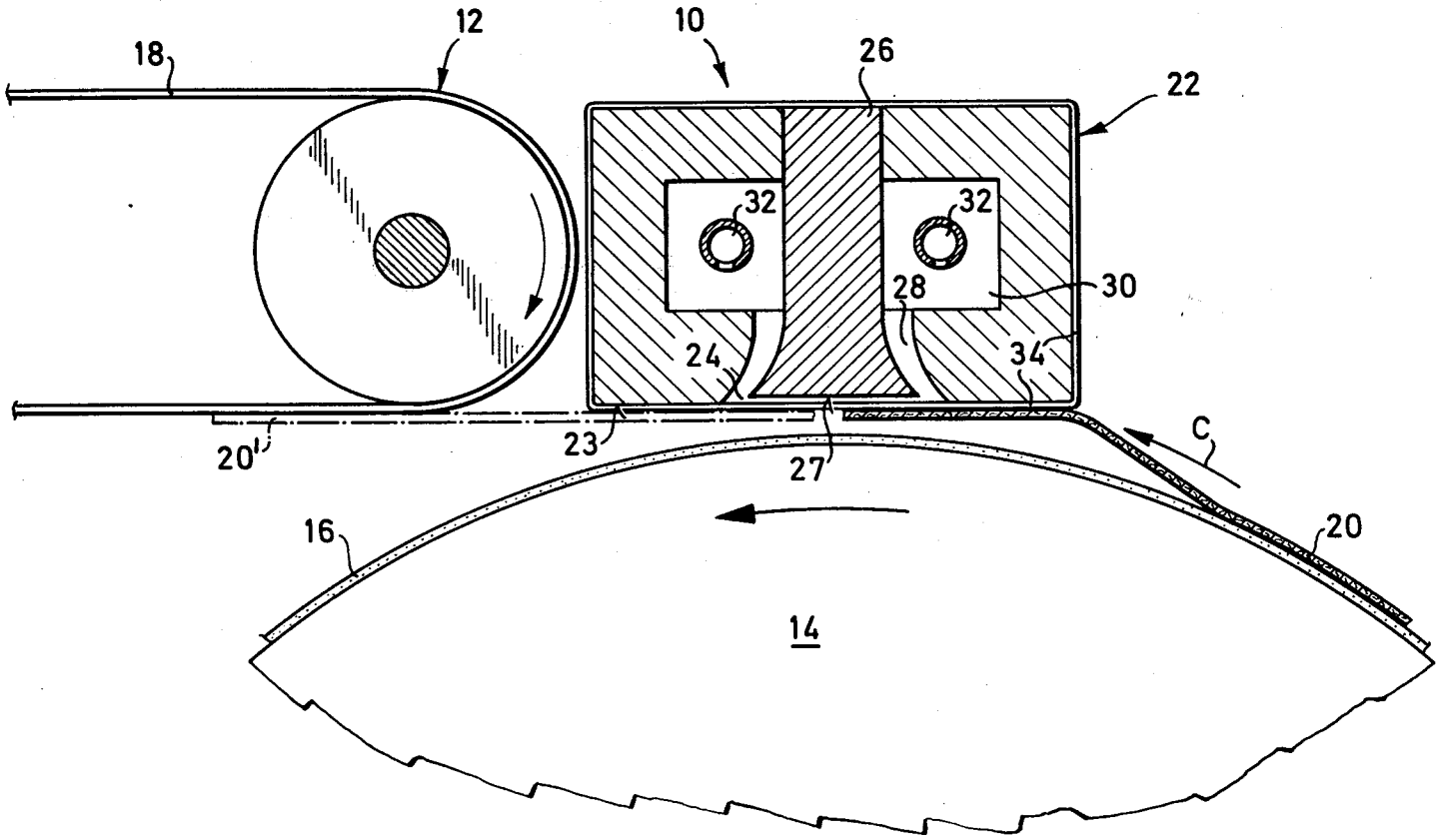
FIG. 3 is a section of an embodiment of a nozzle arrangement with spacers.

FIG. 3 shows a section of an electrophotographic copying apparatus which contains a rotatable drum 14 with a photoconductive layer 16 applied thereto which is uniformly charged in known manner by a corona discharge device (not shown). The image to be copied is projected onto the photoconductive layer 16 at an exposure station, a latent charge image of the image to be copied being obtained by exposure on the photoconductive layer 16. In known manner, the developer mixture is then brought into contact with the latent charge image in a development station. The toner is the developer mixture, which for instance may have a charge of opposite polarity with respect to that of the electrostatic charge image, is attracted, thereby making the latent image visible. The toner image thus obtained is transferred in a transfer station to a copy support 20. The copy support may be plain, commercially available paper, which is either wound from a roll and cut to the desired size as required or which is in the form of individual sheets. Transfer is performed by means of corona discharge device which, in the zone in which the copy support 20 is in contact with the drum 14, leads to ionization of a polarity opposite to that of the toner. This, in turn, attracts the toner to the copy support.

The copy support 20 is detached from the drum 14 by means of a detaching device 10. The detaching device 10 consists of a nozzle arrangement 22 and a transport device 12, which further conveys the copy support 20 drawn from the drum 14 to a fixing station (not shown), in which the non-adhering toner image is fixed onto the copy support 20.

The nozzle arrangement 22, which may, for example, comprise a square body, is arranged at a small distance from the photoconductor layer 16 on the drum 14. The nozzle arrangement 22 is known per se. It contains several individual nozzles 28 arranged one after the other transversely with respect to the direction of transport of the copy support 20. In FIG. 3, the copy support 20 is conveyed from the right to the left, as indicated by the arrow C. As also shown in FIG. 3, the leading edge of the copy support 20 is lifted in the direction of the nozzle outlets 24, while the remaining part of the copy support is still in contact with the photoconductive layer 16 on the periphery of the drum 14.

The nozzle arrangement 22 has a distribution chamber 30 in which the pressure medium, e.g., compressed air or another suitable pressure medium, enters through the pressure supply conduits 32. In the nozzle arrangement 22, there is further provided a diffuser insert 26 of a cross-section conically widened or downwardly diverging towards the bottom. The individual nozzles 28, adapted in their outlines to the course of the diffuser insert 26, terminate at that surface 23 of the nozzle arrangement which faces the copy support 20. By the arrangement of the diffuser inserts 26 in these nozzles 28, annular nozzle outlets 24 are formed in the surface 23. The bottom edge of the diffuser insert 26 ends at a small distance from the surface 23.

The air stream leaving the nozzle outlets 24 lifts the leading edge of the copy sheet. The movement of the air stream between the individual nozzles 28 and the copy sheet produces a pressure below atmospheric, i.e., a suction pressure, as illustrated, for example, in FIGS. 1 and 2. The copy sheet is drawn by this suction pressure close to the nozzle arrangement. The rotating drum 14 further conveys the copy sheet in the direction of the transport device 12, the endless circulating belt 18 of which, e.g., due to electrostatic attraction, comes into contact with the copy sheet and further conveys it. The position of such a copy sheet is dashed-dotted in the drawing and provided with numeral 20'.

Figure 4:
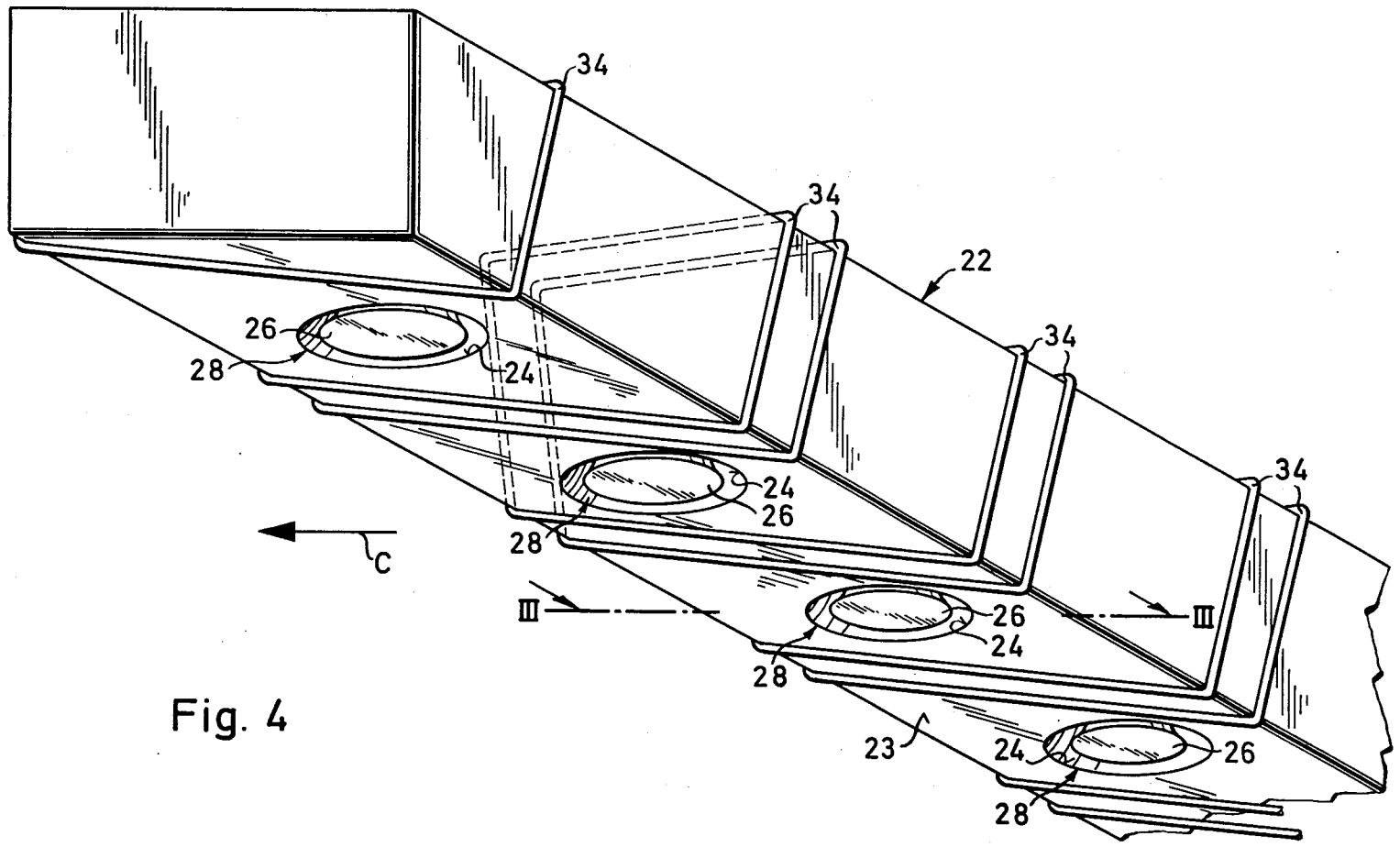
FIG. 4 is a perspective view from below of the nozzle arrangement of FIG. 3.

The nozzle arrangement 22 of FIGS. 3 and 4 has spacers 34 on both sides of each nozzle outlet 24. Spacers 34 are parallel to one another but inclined with respect to the lateral edges of the nozzle arrangement 22. The spacers 34 may advantageously be composed of Teflon wires of a diameter of 1 mm or less, and particularly of a diameter of 0.5 mm. It is desirable to select the diameter of the spacers to be as small as possible so that the contact force of the copy sheet on these spacers is as small as possible thereby ensuring safe further transport of the copy sheet. The Teflon wires are wound in pairs parallel to one another onto the square nozzle arrangement 22, the path of two neighboring wires on a lateral surface of the nozzle arrangement being oblique to the edges of the lateral surface. On the surface 23 of the nozzle arrangement 22, the spacers 34 are oblique with respect to the direction of movement C of the copy support 20, the advantage being achieved that a copy sheet with a folded-down corner can be removed and is not squeezed in the zone of the spacers 34.

By way of the arrangement of the spacers 34, sufficient flowing off of the compressed air is ensured, even when the nozzle outlets 24 are convered by the copy support 20. Also, the back of the copy support 20 to be detached is always exposed to a pressure below atmospheric. There then results, as shown in FIG. 2, the functional relationship according to curve B between, on the one hand, the pressure below atmospheric and, on the other hand, the distance between the copy support 20 and the nozzle outlets 24. By way of the spacers 34, movement of the copy sheet to be detached into a zone of superatmospheric pressure is avoided, i.e., the copy sheet is handled only in the suction zone as represented by curve B of FIG. 2. The compressed air leaving the nozzle outlets 24 thus further impinges tangentially on the back of the copy support 20 since it can flow off laterally between the spacers 34.

Figure 5A:
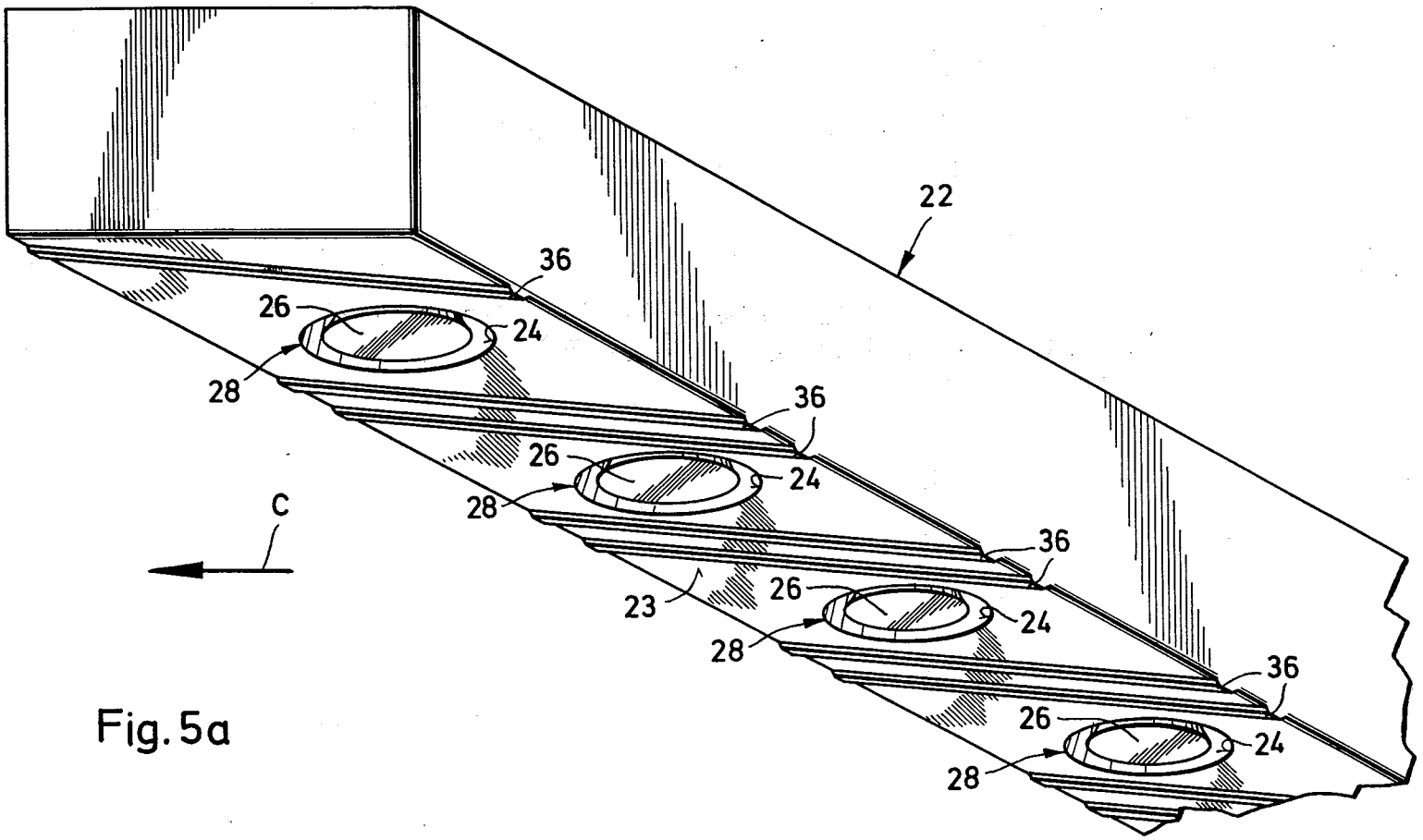
FIG. 5*a* is a side-elevation of another embodiment of the invention wherein corrugations are used in connection with the nozzle arrangement.

Another embodiment of the nozzle arrangement 22 is shown in FIG. 5*a*. There, corrugations 36 serve as spacers for the copy support 20. The corrugations are disposed on both sides of each nozzle outlet 24 in the surface 23 of the nozzle arrangement 22. These corrugations 36 are pre-formed with the production of the nozzle arrangement 22 and are parallel to one another and oblique to the lateral edges of the surface 23.

Figure 5B:
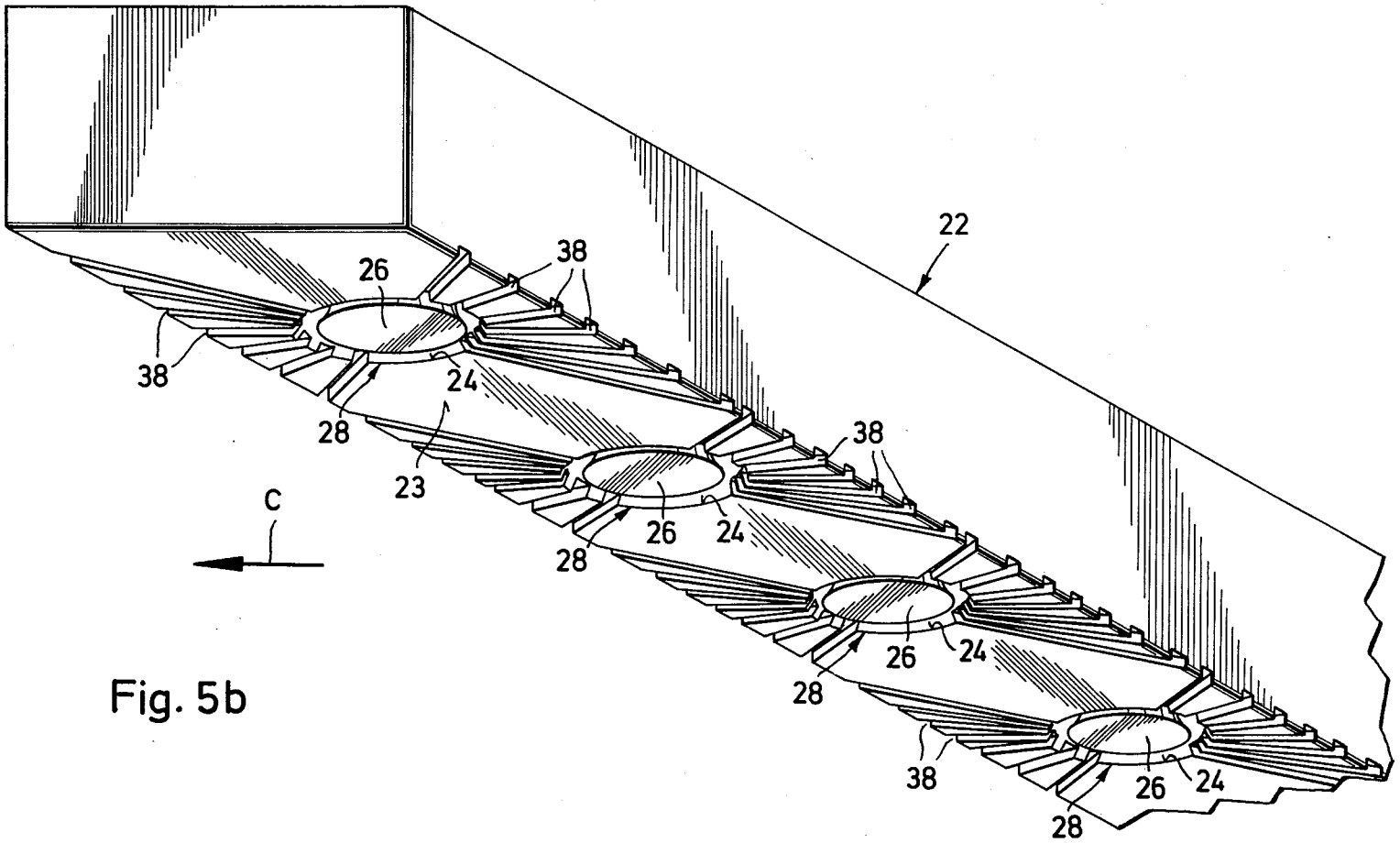
FIG. 5*b* shows another embodiment of the invention wherein grooves are used in connection with the nozzle arrangement.

In another embodiment, as shown in FIG. 5*b*, instead of spacers, grooves 38 may pass from each nozzle outlet 24 in that surface 23 of the nozzle arrangement 22 which faces the copy support 20. In this embodiment, the in-flowing compressed air which passes through the nozzle is distributed via the grooves 38, which may, for example, extend radially from the nozzle outlets 24.

Figure 6:
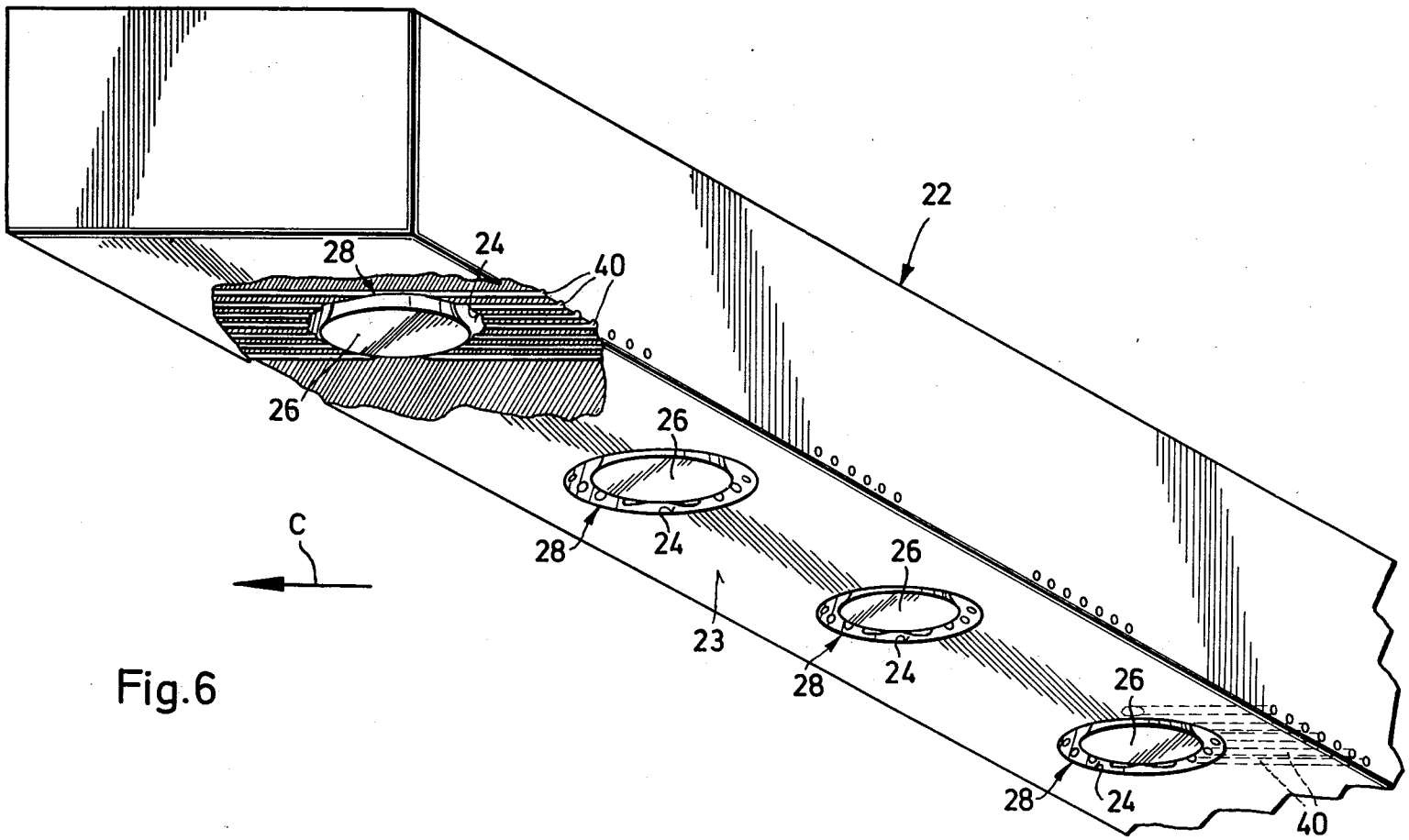
FIG. 6 shows another embodiment of the invention wherein lateral channels are used in connection with the nozzle arrangement.

In still another embodiment, as shown in FIG. 6, channels 40 draw off the compressed air from the interior of each nozzle 28 in the vicinity of the nozzle outlets 24 as soon as the copy support 20 covers the nozzle outlets 24. This also ensures that the back of the copy support 20, even in the case where the nozzle outlets 24 are covered, is only exposed to a suction pressure, i.e., a pressure below atmospheric, and not to a superatmospheric pressure. The channels 40 are parallel to each other and to the surface 23 and are disposed in the interior of the nozzle arrangement 22 adjacent to but at a small distance from surface 23. The channels 40 terminate in the lateral surfaces of the nozzle arrangement 22 and are open at their ends.

What is claimed is:

1. A device for detaching a sheet-shaped copy support from a moving photoconductive layer by fluid pressure, the detaching device comprising:
   a. a body having one side for cooperation with a copy support;
   b. a nozzle in said body, said nozzle having an outlet at said one side of said body;
   c. first directing means, operatively coupled with said nozzle, for directing flow of fluid from said nozzle so as to draw a copy support toward said one side of said body;
   d. second directing means, also operatively coupled with said nozzle, for directing flow of fluid away from the region of said nozzle outlet to discharge the fluid when a copy support has moved into close relationship with respect to said nozzle outlet;
   e. said second directing means including spacers arranged on both sides of said nozzle outlet for maintaining a copy support in spaced relation to said one side of said body;
   f. said spacers being elongated, straight elements arranged on said body in parallel relationship to one another and in oblique disposition with respect to the direction of transport of a copy support;
   g. said spacers comprising wires of a plastic material of a diameter of 1 mm or less disposed on said one side of said body;
   h. whereby the side of the copy support cooperating with the nozzle outlet is constantly subject to a pressure below atmospheric and oscillations of the copy support are prevented.

2. A detaching device according to claim 1, wherein said wires have a diameter of 0.5 mm.

3. A detaching device according to claim 1, wherein the copy support is a sheet of paper.

4. A detaching device according to claim 1, including a plurality of nozzle outlets in said body, said first and second directing means being operatively coupled with each nozzle outlet.

* * * * *

UNITED STATES PATENT OFFICE

CERTIFICATE OF CORRECTION

Patent No. 4,034,977 Dated July 12, 1977

Inventor(s) Helmut Jähn

It is certified that error appears in the above-identified patent and that said Letters Patent are hereby corrected as shown below:

Column 4, line 24, "is" should read -- in --.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*